US005664676A

United States Patent [19]

Levins

[11] Patent Number: 5,664,676

[45] Date of Patent: Sep. 9, 1997

[54] BOOK DISPLAY BOX

[76] Inventor: Michael Levins, 317 Greens Farms Rd., Westport, Conn. 06880

[21] Appl. No.: 725,339

[22] Filed: Oct. 1, 1996

[51] Int. Cl.[6] ..... A45F 5/12

[52] U.S. Cl. ..... 206/424; 206/45.23; 211/50

[58] Field of Search ..... 206/424, 45.2, 206/45.23–45.26; 211/42, 50; 281/33, 45

[56] References Cited

U.S. PATENT DOCUMENTS

| | | | |
|---|---|---|---|
| 1,319,973 | 10/1919 | Simpson | 206/45.2 |
| 3,820,709 | 6/1974 | Sieffert . | |
| 4,006,822 | 2/1977 | McCall . | |
| 4,015,769 | 4/1977 | Erlich . | |
| 4,227,328 | 10/1980 | Clipper, Jr. . | |
| 4,323,214 | 4/1982 | DeLuca . | |
| 4,700,831 | 10/1987 | Kassai . | |
| 4,708,239 | 11/1987 | Bourbon | 206/45.23 |
| 4,779,752 | 10/1988 | Vallee et al. . | |
| 4,781,384 | 11/1988 | Bois . | |
| 4,892,195 | 1/1990 | Slavin et al. . | |
| 4,896,252 | 1/1990 | Stewart . | |
| 4,998,703 | 3/1991 | Stewart . | |
| 5,014,907 | 5/1991 | Hollander et al. . | |
| 5,029,798 | 7/1991 | Clark | 206/45.24 |
| 5,040,216 | 8/1991 | Policht . | |
| 5,064,114 | 11/1991 | Cravens . | |
| 5,096,056 | 3/1992 | Garcia . | |
| 5,145,068 | 9/1992 | Schmitz et al. . | |
| 5,187,838 | 2/1993 | Fontana . | |
| 5,248,037 | 9/1993 | Kornberg et al. . | |
| 5,282,537 | 2/1994 | Wong . | |
| 5,301,800 | 4/1994 | Kenney | 211/50 |
| 5,456,352 | 10/1995 | McQueeny . | |
| 5,460,102 | 10/1995 | Pasmanick . | |

*Primary Examiner*—Paul T. Sewell
*Assistant Examiner*—Nhan Lam
*Attorney, Agent, or Firm*—Hedman, Gibson & Costigan, P.C.

[57] ABSTRACT

A display book box is disclosed which is useful for carrying a relatively large book and which is constructed in a manner such that when it is opened it can function as a display easel for the book contained therein. The display box also provides punch out supports and an insert piece to support one or more books.

10 Claims, 4 Drawing Sheets

BOOK DISPLAY BOX

The present invention relates to a box for carrying a relatively large book which is constructed in a manner such that when it is opened it can function as a display easel for the book contained therein.

BACKGROUND OF THE INVENTION

Boxes for containing a variety of articles have long been known. Included among the known boxes are those which are useful in carrying one or more books. In this regard, the box is usually sufficient to contain the book to protect it from the outside elements and to facilitate its carrying.

Similarly, in making various book presentations, it is desirable to have a display stand on which to display the books which are being presented to the audience in a manner in which the book is readily visible. In this regard, relatively large books are preferred. Accordingly, various display means have been developed to facilitate the displaying of relatively large books.

However, there have been no attempts in prior art to combine these two features in a simple device, a box which is suitable for facilitating the protection and transportation of the book, and which can also function as a display easel for presenting the book. To this end, the present inventor has developed a book display box which can provide both functions.

SUMMARY OF THE PRESENT INVENTION

It is an object of the present invention to provide a box which is useful in protecting a book from the outside elements.

It is another object of the present invention to provide a box which is useful in facilitating the transportation of a book.

It is a further object of the present invention to provide a display means for displaying a book to an audience.

It is a still further object of the present invention to provide a device which will protect a book from the outside elements, facilitate the transportation of the book and includes a simple means for displaying the book to an audience.

Accordingly, the display book box of the present invention comprises (a) a relatively larger upper section comprising (i) a pair of opposing side walls each side wall having a horizontally planar top end, a front end of length x, a back end of length y, wherein x>y, and a bottom end extending angularly downward from the bottom of the back end to the bottom of the front end; (ii) a back wall coupled to the back ends of the side walls; (iii) a front wall coupled to the front ends of the side walls; and (iv) a top wall coupled to the top ends of the side walls, the back wall and the front wall; (b) a relatively smaller lower section comprising (i) a pair of opposing side walls each side wall having a horizontally planar bottom end, a front end of length p, a back end of length q, wherein q>p, and a top end extending angularly downward from the top of the back end to the bottom of the front end; (ii) a back wall coupled to the back ends of said side walls; (iii) a front wall coupled to the front ends of the side walls; and (iv) a top wall coupled to the bottom ends of the side walls, the back wall and the front wall; and (c) an insert having a length l and width w, the width w being sufficient to slidably fit within said bottom section, and said length l being greater than p and less than p+x; and wherein the upper section and lower section are hingeably connected along the bottom edge of the back wall of the upper section and the upper edge of the back wall of the lower section, whereby when the box is opened along the hinge a book can be supported and displayed by the bottom section and the insert.

Figure 1:
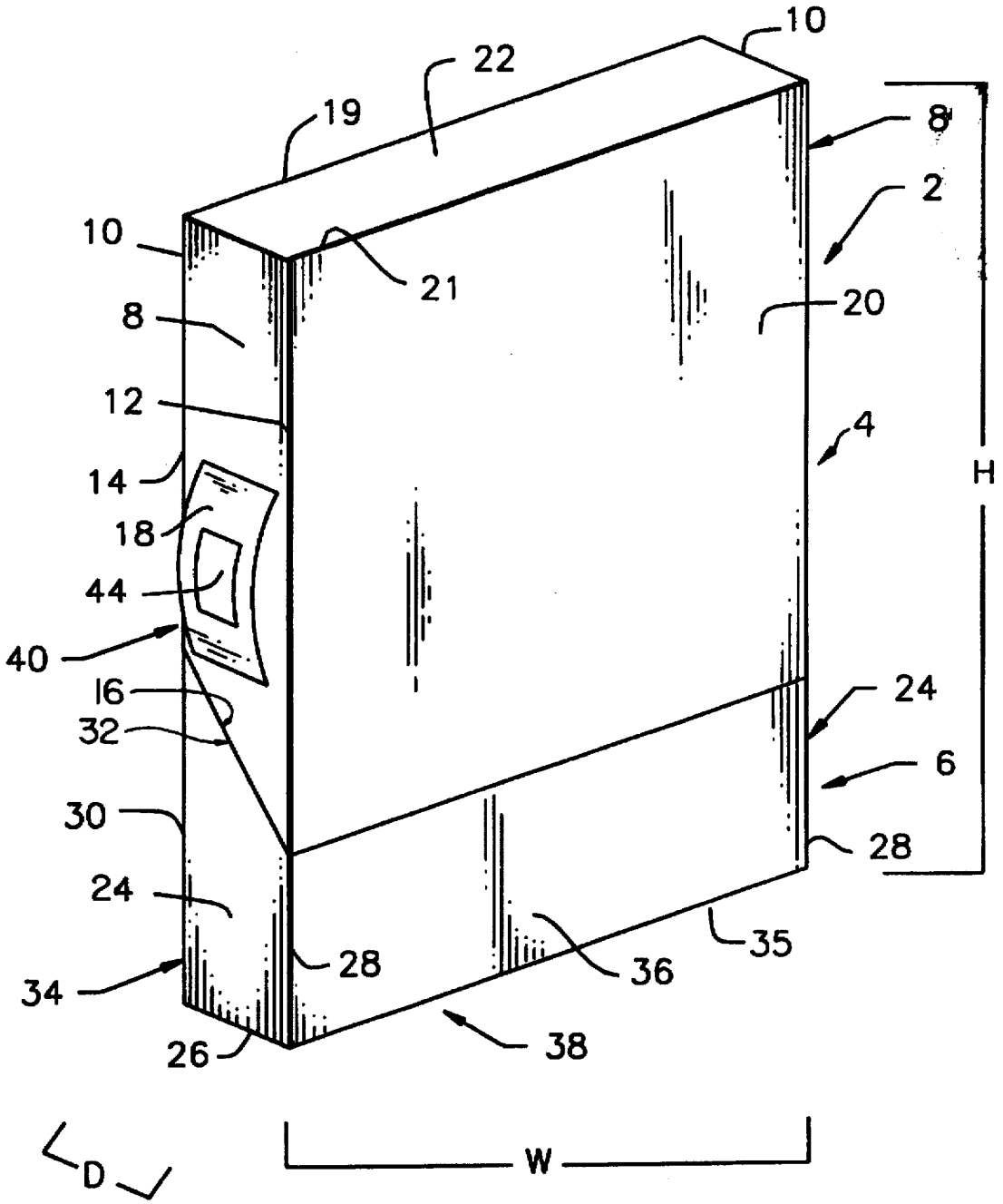
FIG. 1 depicts a box of the present invention in its closed position.

DETAILED DESCRIPTION OF THE PRESENT INVENTION AND DESCRIPTION OF THE PREFERRED EMBODIMENTS

Referring to FIGS. 1–4, the book box 2 is comprised of an upper section 4 and a lower section 6. The upper section 4 has a pair of opposing side walls 8 each side wall having an upper edge 10, a front edge 12, a back edge 14 and a bottom edge 16. The front edge 12 has a length x, and the back edge 14 has a length y, where x>y. In this manner, the bottom edge 16 extends angularly downward from the back edge 14 to the front edge 12. The top edge 10 is horizontally planar.

The upper section also comprises a back wall 18 and a front wall 20. The back wall 18 is coupled to the back edges 14 of the side walls 8 and the front wall 20 is coupled to the front edges 12 of the side walls 8. Coupled to the top ends 10 of the side walls and the top end 21 of the front wall 20 and the top end 19 of the back wall 18 is a top wall 22.

The bottom section 6 of the book box 2 has a pair of opposing side walls 24 each side wall having an upper edge 32, a front edge 28, a back edge 30 and a bottom edge 26. The front edge 28 has a length p, and the back edge 30 has a length q, where q>p. In this manner, the top edge 32 extends angularly downward from the back edge 30 to the front edge 28. The bottom edge 26 is horizontally planar.

The bottom section also comprises a back wall 34 and a front wall 36. The back wall 34 is coupled to the back edges 30 of the side walls 24 and the front wall 36 is coupled to the front edges 28 of the side walls 24. Coupled to the bottom ends 26 of the side walls 24 and the bottom end 35 of the front wall 36 and the bottom end 33 of the back wall 34 is a bottom wall 38.

The display book box of the present invention further comprises an insert piece 42 which has a length l and a width w wherein the width w is sufficient to slidably fit within said bottom section 6. The length l of the insert piece 42 is sufficiently long to extend above the back wall 34 of the bottom section 6. In this manner the insert piece 42 can be deposited against the back wall 34 of the bottom section 6 such that the insert piece provides an elongated back wall to the bottom section against which a book 48 may rest during display.

The insert piece 42 may be separate from the rest of the display book box 2 or it may be attached, such as by an adhesive to the back of the bottom section 6 of the display book box 2. Preferably it is attached.

In another preferred embodiment, the insert piece 42 may comprise end flaps 46 which fold out perpendicularly to the insert piece 42. The flaps 46 help to secure the books in the box during display.

Figure 2:
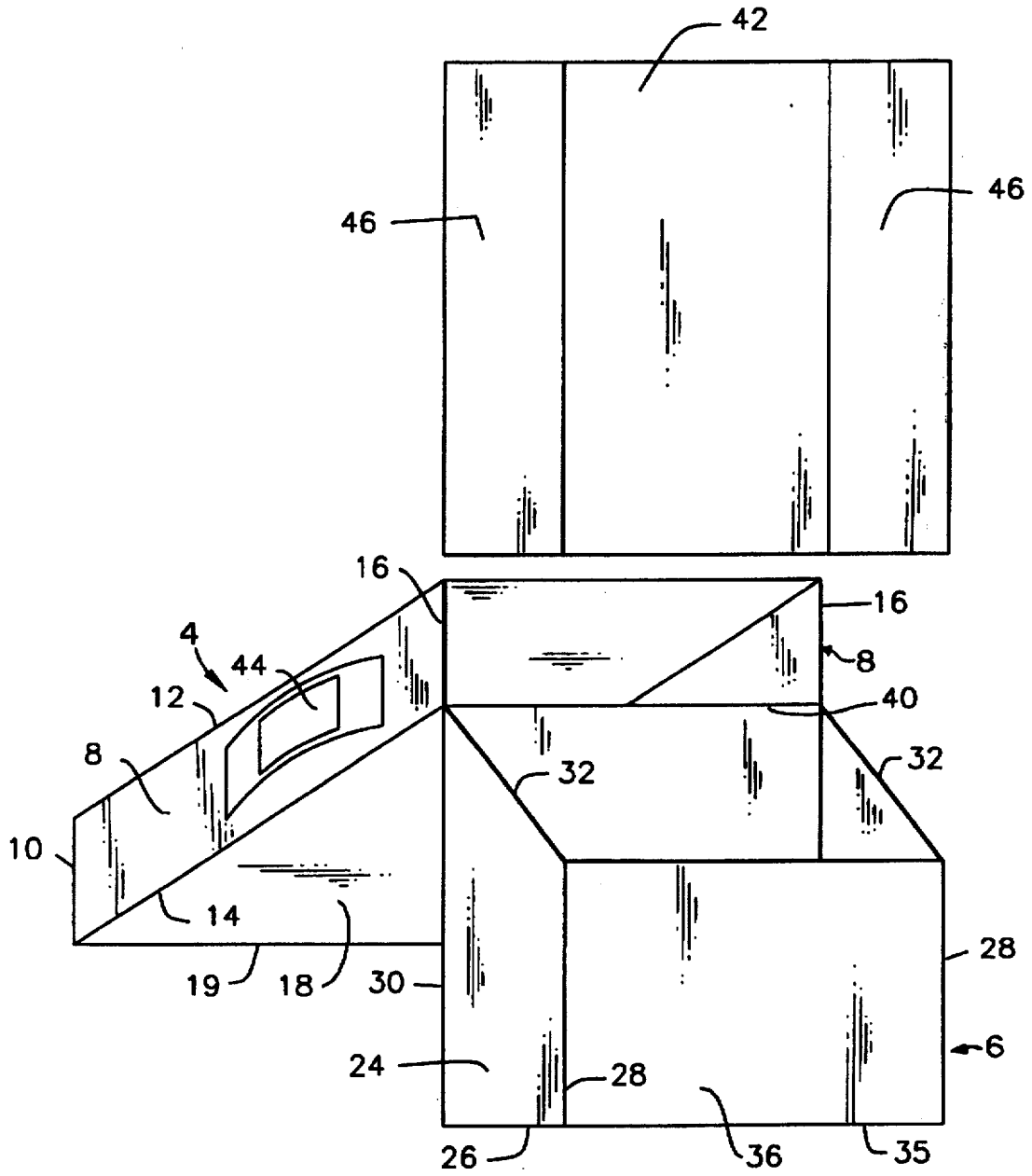
FIG. 2 depicts an embodiment of a box of the present invention in its open position.
Figure 3:
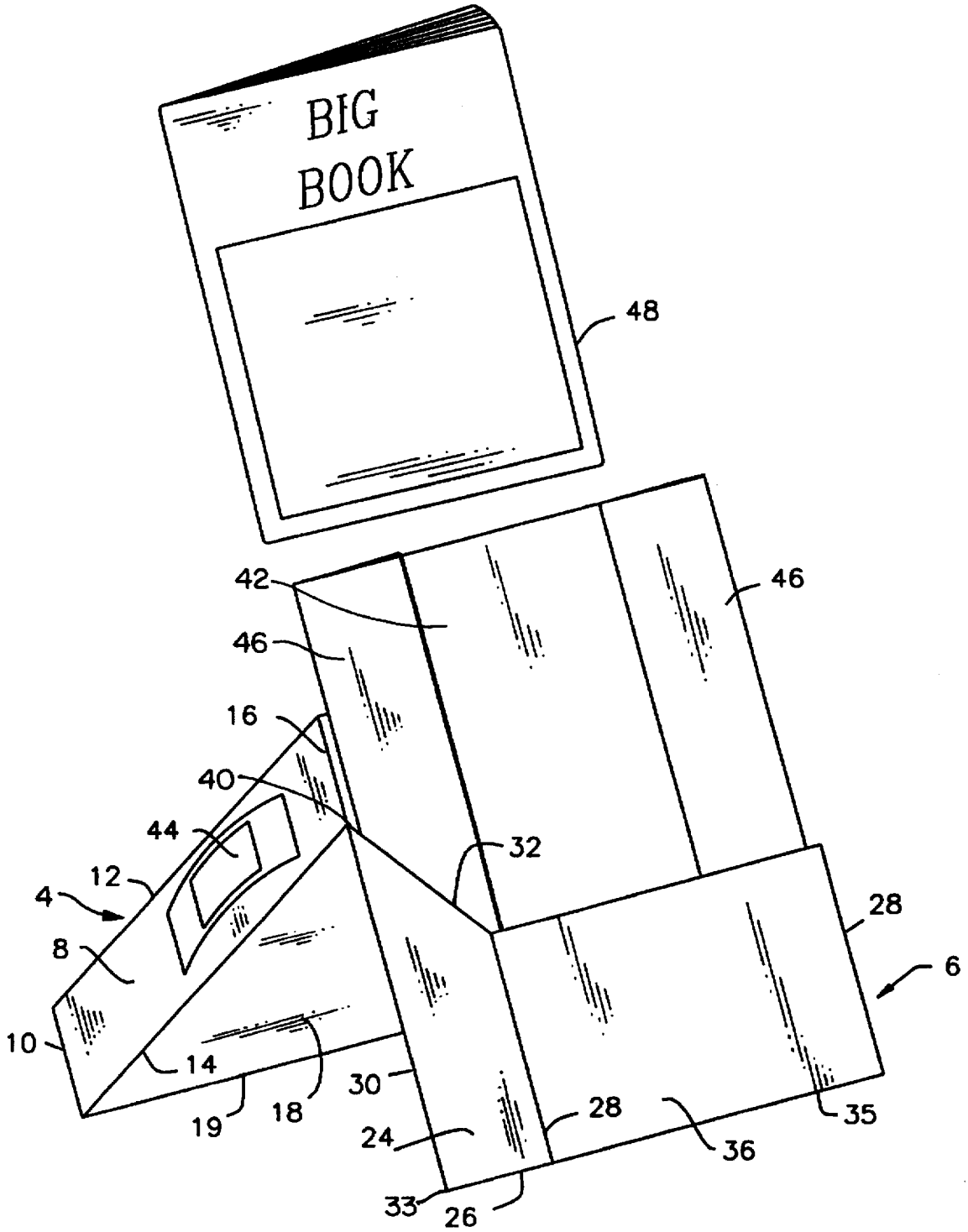
FIG. 3 depicts an embodiment of a box of the present invention as a display stand.
Figure 4:
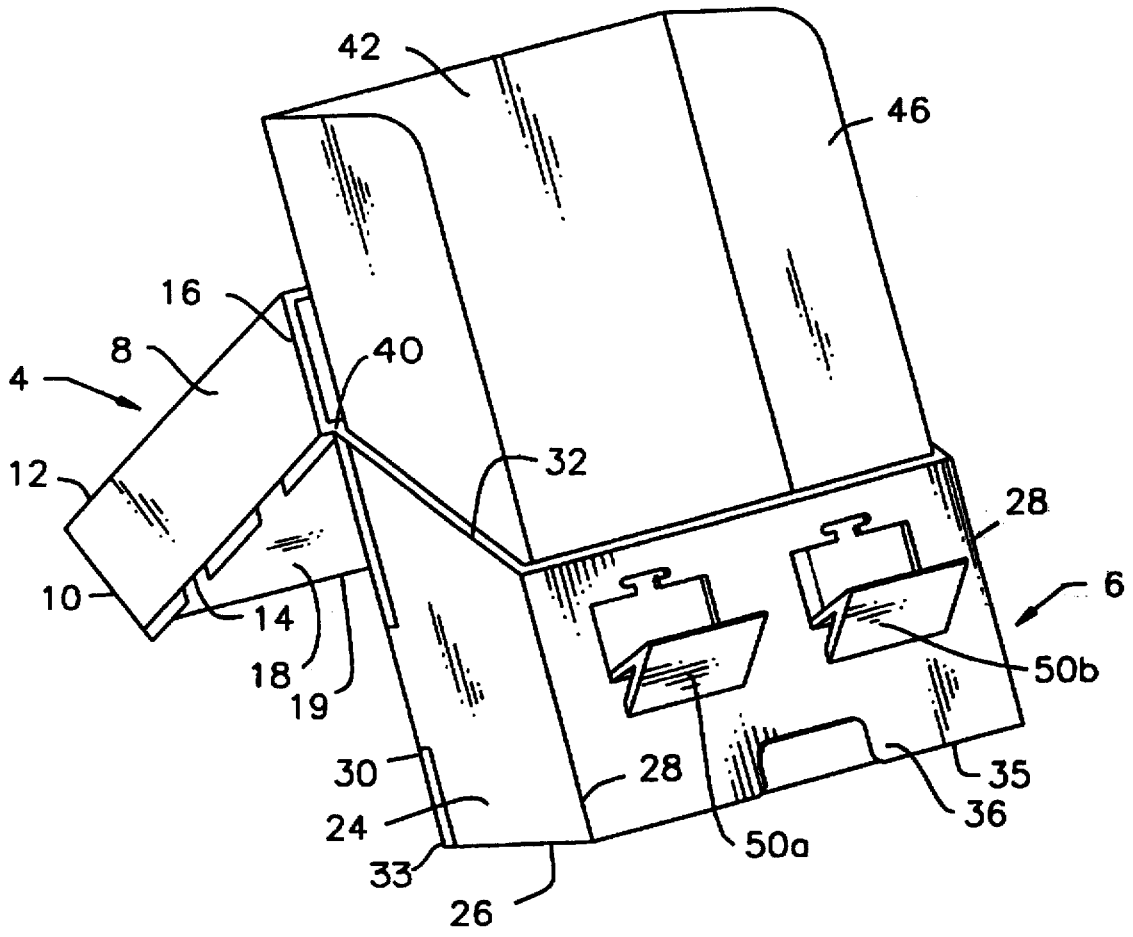
FIG. 4 depicts another embodiment of a box of the present invention as a display stand.

In operation, the box 2, in a closed position as shown in FIG. 1, is opened by bending back the top portion 4 along the hinge 40 (see FIGS. 2–4). The hinge 40 is formed along the connection between the upper portion 4 and the lower portion 6. Any hinge means known to those skilled in the art may be employed. Especially preferred is the use of a duo-fold hinge formed between the bottom edge of the back wall 18 of the upper portion 4 and the top edge of the back wall 34 of the lower portion 6.

When opened, as shown in FIG. 3, the box 2 forms a display unit, wherein a book 48 may be placed in the bottom portion 6 and supported along its back by the insert means 42. The top portion 4 acts as a support stand to keep the display in an angularly upright position.

In an especially preferred embodiment, as shown in FIG. 4, the front wall 36 of the bottom portion 6 may be provided with punch out supports 50*a* and 50*b* which allow a book to be removed from the bottom portion 6 and rested on the punch out supports 50*a* and 50*b*. In this manner, the book may be browsed and viewed by the audience.

The display book box of the present invention may be constructed of any of the known light weight and strong materials typically employed in the construction of boxes, such as cardboards and plastics. Especially preferred is cardboard. The outside of the book can be printed upon through a variety of known processes for graphics.

The display book box of the present invention is especially useful in the display of relatively large books which can be viewed by a plurality of persons, such as students in a classroom setting. In this regard, the box (both the upper and lower sections combined) has the following preferred approximate dimensions, 20 to 28 inches in height (H), 14 to 22 inches in width (W) and 1½ to 3½ inches in depth (D). Especially preferred is a display book box having a height (H) of 23 inches, a width (W) of 18 inches and a depth (D) of 2½ inches. In this manner, the display book box will be able to accommodate 16–20 big books ranging from 13"× 15" to 17"×22" in size.

Many variations of the present invention will suggest themselves to those skilled in the art in light of the above-detailed description. For example, one of the side walls of the box may include a handle means 44 (see FIGS. 1–3). Additionally, any hinge means may be employed to connect the upper and lower portions. Similarly, a latching means may be provided on either the side walls or the front walls of the upper and lower sections to secure the upper section to the lower section during transportation of books in the box. All such obvious modifications are within the full intended scope of the appended claims.

I claim:

1. A display book box comprising:

(a) an upper section comprising:

(i) a pair of opposing side walls each said side wall having a horizontally planar top end, a front end of length x, a back end of length y, wherein x>y, and a bottom end extending angularly downward from the bottom of the back end to the bottom of the front end;

(ii) a back wall coupled to the back ends of said side walls;

(iii) a front wall coupled to the front ends of said side walls; and (iv) a top wall coupled to the top ends of the side walls, the back wall and the front wall;

(b) a lower section comprising:

(i) a pair of opposing side walls each said side wall having a horizontally planar bottom end, a front end of length p, a back end of length q, wherein q>p, and a top end extending angularly downward from the top of the back end to the top of the front end;

(ii) a back wall coupled to the back ends of said side walls;

(iii) a front wall coupled to the front ends of said side walls; and (iv) a bottom wall coupled to the bottom ends of the side walls, the back wall and the front wall;

(c) an insert having a length l and a width w, the width w being sufficient to slidably fit within said bottom section, and said length l being greater than p and less than p+x; and wherein said upper section and said lower section are hingeably connected along the bottom edge of the back wall of said upper section and the upper edge of the back wall of said lower section, and whereby when the box is opened along said hinge a book can be supported and displayed by said bottom section and said insert.

2. A display book box as defined in claim 1 wherein one of the side walls of the upper section further comprises a handle.

3. A display book box as defined in claim 1 wherein one of the side wall of the lower section further comprises a handle.

4. A display book box as defined in claim 1 wherein the entire box in a closed position has the dimensions of a height H ranging from about 20 to about 28 inches, a width W ranging from about 14 to about 22 inches and a depth D ranging from about 1½ to about 3½ inches.

5. A display book box as defined in claim 4 wherein said height H is 23 inches, said width W is 18 inches and said depth D is 2½ inches.

6. A display book box as defined in claim 4 which is suitable for holding and displaying from about 16 to about 20 big books ranging from 13"×15" to 17"×22 in size.

7. A display book box as defined in claim 1 wherein said front wall of the lower portion is further provided with a plurality of punch out supports.

8. A display book box as defined in claim 7 wherein said front wall of the lower portion is provided with two punch out supports.

9. A display book box as defined in claim 1 wherein said insert is removable from said display book box.

10. A display book box as defined in claim 1 wherein said insert is fixably attached to the inside of the back wall of the lower portion.

* * * * *